US006825819B2

(12) United States Patent
Kim et al.

(10) Patent No.: US 6,825,819 B2
(45) Date of Patent: Nov. 30, 2004

(54) CERAMIC CHIP ANTENNA

(75) Inventors: Hyun-Jai Kim, Seoul (KR); Seok-Jin Yoon, Seoul (KR); Ji-Won Choi, Seoul (KR); Chong-Yun Kang, Seoul (KR); Sung-Hun Sim, Seoul (KR)

(73) Assignee: Korean Institute of Science and Technology, Seoul (KR)

( * ) Notice: Subject to any disclaimer, the term of this patent is extended or adjusted under 35 U.S.C. 154(b) by 0 days.

(21) Appl. No.: 10/301,243

(22) Filed: Nov. 20, 2002

(65) Prior Publication Data

US 2003/0222822 A1 Dec. 4, 2003

(30) Foreign Application Priority Data

May 31, 2002 (KR) ..... 10-2002-30514

(51) Int. Cl.[7] ..... H01Q 1/24
(52) U.S. Cl. ..... 343/895; 343/700 MS
(58) Field of Search ..... 343/700 MS, 702, 343/873, 895, 700, 823, 846, 787, 788

(56) References Cited

U.S. PATENT DOCUMENTS

| | | | | | |
|---|---|---|---|---|---|
| 6,023,251 | A | * | 2/2000 | Koo et al. | 343/895 |
| 6,650,303 | B2 | * | 11/2003 | Kim et al. | 343/895 |
| 2002/0067312 | A1 | * | 6/2002 | Hilgers | 343/700 MS |
| 2002/0118075 | A1 | * | 8/2002 | Ohwada | 343/860 |

* cited by examiner

*Primary Examiner*—James Vannucci
*Assistant Examiner*—Jimmy T. Vu
(74) *Attorney, Agent, or Firm*—Jones Day

(57) ABSTRACT

A ceramic chip antenna for use in ultra-high frequency communications. The ceramic chip antenna according to the present invention comprises a main body, first and second helical conductors, and a single power supply section for supplying power to the first and second helical conductors. The main body is produced by laminating a plurality of ceramic sheets made of a dielectric material. The first and second helical conductors are formed inside the main body by a screen-printing method. The first and second helical conductors have the same axis of helical rotation, as view from the power supply section.

8 Claims, 7 Drawing Sheets

CERAMIC CHIP ANTENNA

FIELD OF THE INVENTION

The present invention relates to a ceramic chip antenna, and more particularly, to a ceramic chip antenna of a helix structure with application to a wireless communication system.

BACKGROUND OF THE INVENTION

Ceramic chip antennas have been widely accepted as an antenna element in the field of wireless communications due to their compactness. Typically, as shown in FIG. 1, such ceramic chip antennas include a helical conductor of a single helix structure embedded by printing into a main body composed of a plurality of laminated ceramic sheets. The helical conductor comprises a plurality of first horizontal strip lines 4*a* and a plurality of second horizontal strip lines 4*b*, both of which are thickly printed on the ceramic sheets. The helical conductor further comprises a plurality of vertical strip lines 5*a* and 5*b* that are produced by filling via holes (formed in the ceramic sheets) with conductive material. First horizontal strip lines 4*a*, second horizontal strip lines 4*b*, and vertical strip lines 5*a* and 5*b* are electrically connected to form an integral structure.

However, this single helical conductor structure poses a problem in terms of bandwidth when applied to a wireless communication system. Ceramic chip antenna 100 in FIG. 1 does not meet the wideband frequency characteristics required by a typical wireless communication system such as a mobile phone, WLAN, Bluetooth etc.

Alternatively, a ceramic chip antenna as shown in FIG. 2A is often used to meet the required wideband frequency characteristics of wireless telecommunication systems. Ceramic chip antenna 200 in FIG. 2A includes two helical conductors 7 and 8, which have different axes of helical rotation A, B, respectively. The structure of ceramic chip antenna 200 is further described with reference to FIG. 2B. First helical conductor 7 is formed by electrically connecting a plurality of first horizontal strip lines 7*a*, which are thickly printed on first ceramic sheet 6*a*, a plurality of vertical strip lines 7*b*, which are produced by filling via holes (not shown) formed in second ceramic sheet 6*b* and third ceramic sheet 6*c* with conductive materials, and a plurality of second horizontal strip lines 7*c*, which are thickly printed on fourth ceramic sheet 6*d*. Similarly, second helical conductor 8 is formed by connecting a plurality of third horizontal strip lines 8*a*, which are thickly printed on first ceramic sheet 6*a*, a plurality of vertical strip lines 8*b*, which are produced by filling via holes (not shown) formed in second ceramic sheet 6*b* and third ceramic sheet 6*c* with conductive materials, and a plurality of fourth horizontal strip lines 8*c*, which are also thickly printed on fourth ceramic sheet 6*d*. Power supplying terminals 9 and 10 are formed on first ceramic sheet 6*a*.

As explained above, horizontal strip lines 7*a*, 7*c*, 8*a* and 8*c* are thickly printed on first and fourth ceramic sheets 6*a* and 6*d* to form the two helical conductors, so that the structure of ceramic chip antenna 200 avoids complexity in manufacturing. However, two problems are encountered with ceramic chip antenna 200: the size of the antenna inevitably becomes large because helical conductors 7 and 8 have different axes of helical rotation A and B from each other; and the structure of the antenna becomes complicated as two power supplying terminals 9 and 10 must be provided.

Accordingly, a need in the art exists to provide a ceramic chip antenna with a simple structure, which can be manufactured in an efficient manner while meeting wideband frequency requirements.

SUMMARY OF THE INVENTION

Therefore, an object of the present invention is to provide a ceramic chip antenna meeting wideband frequency requirements and having a simple structure for efficient manufacturing.

In accordance with one aspect of the present invention, a ceramic chip antenna is provided that comprises a main body formed by laminating a plurality of ceramic sheets made of a ceramic dielectric material, first and second helical conductors formed inside the main body, and a power supply section coupled to the first and second helical conductors for supplying power thereto, wherein the first and second helical conductors have the same axis of helical rotation as viewed from the power supply section.

BRIEF DESCRIPTION OF DRAWING

The above and other objects and features of the present invention will become apparent from the following description of the preferred embodiment given in conjunction with the accompanying drawing.

DETAILED DESCRIPTION OF THE PRESENT INVENTION

Figure 3:
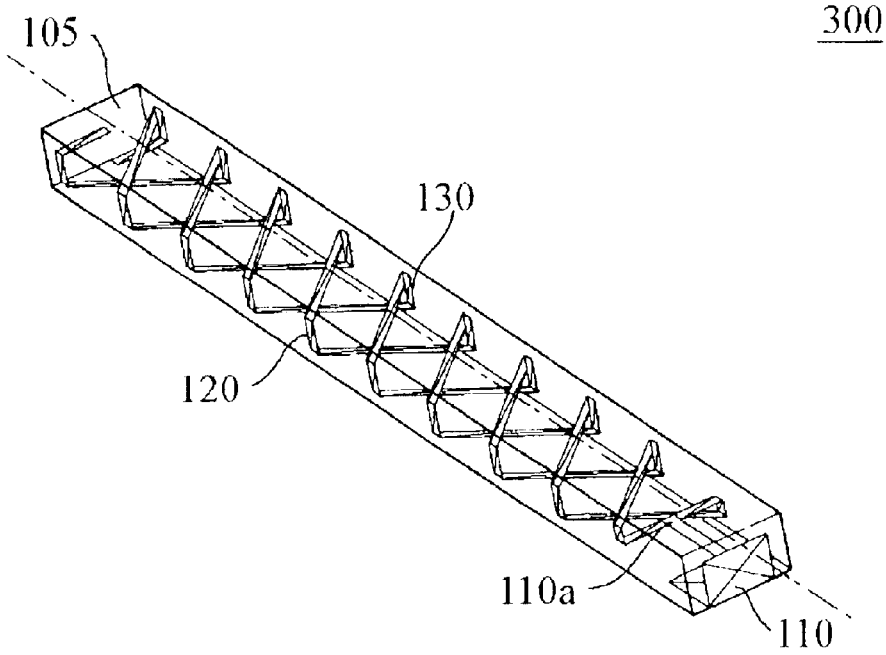
FIG. 3 shows a structure of a ceramic chip antenna in accordance with one embodiment of the present invention.

FIG. 3 shows a structure of a ceramic chip antenna in accordance with one embodiment of the present invention. Ceramic chip antenna 300 comprises main body 105 having a rectangular parallelepiped shape, which is formed by laminating a plurality of ceramic sheets, first helical conductor 120 and second helical conductor 130 for forming a dual helix structure inside main body 105, and a power supply section coupled to first and second helical conductors 120 and 130 for applying a supply voltage thereto. First and second helical conductors 120 and 130 share the same axis of helical rotation as viewed from the power supply section, which makes the structure of the ceramic chip antenna simple. Moreover, the power supply section applies a supply voltage to each of helical conductors 120 and 130 so that the structure of the ceramic chip antenna is as similarly simple as if one independent helical antenna were provided inside the chip.

Figure 4A:
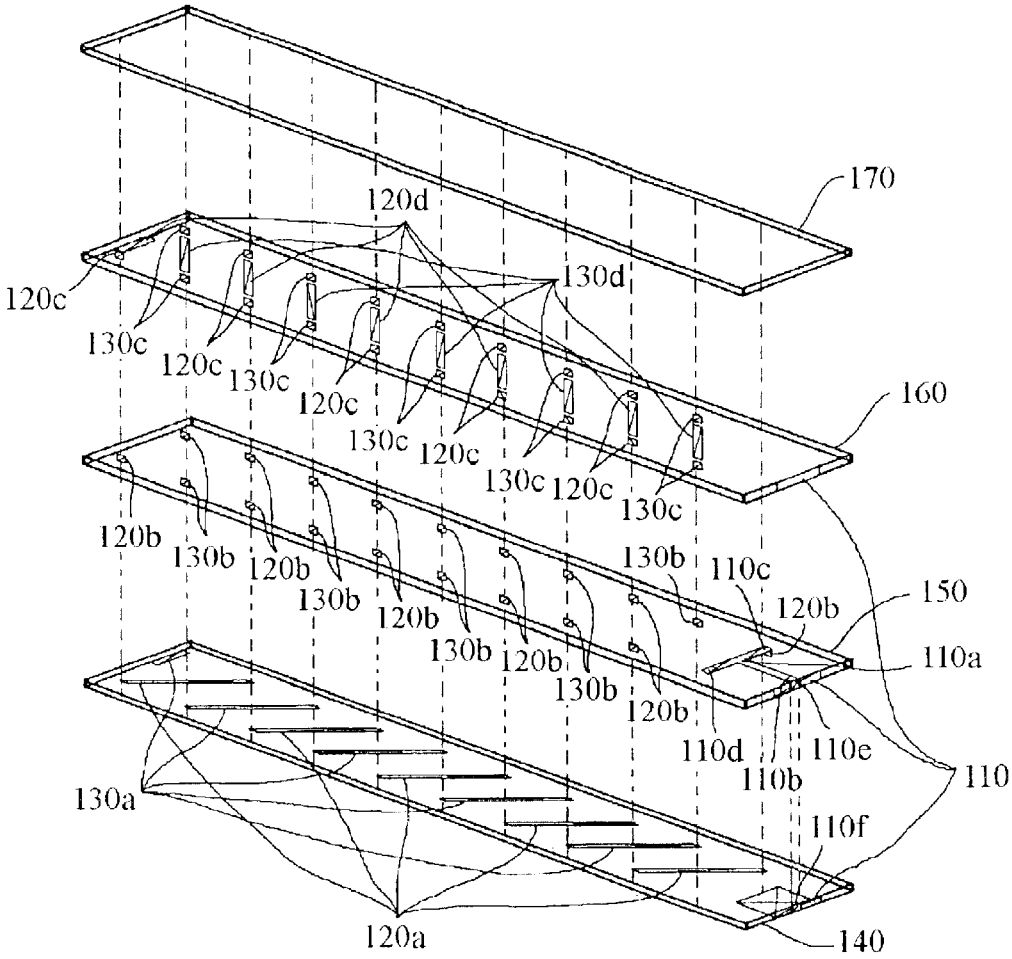
FIG. 4A is an exploded view of the ceramic chip antenna shown in FIG. 3.

The structure of ceramic chip antenna 300 will now be described in more detail with reference to FIGS. 4A and 4B. FIG. 4A is an exploded view of the ceramic chip antenna as shown in FIG. 3. Ceramic chip antenna 300 comprises a plurality of laminated dielectric ceramic sheets 140, 150, 160 and 170. On first ceramic sheet 140, first horizontal strip lines 120*a* are thickly printed. The "thick printing" technique is a conventional technique for providing an electrode pattern on a thick ceramic sheet with a thickness of 50–300 μm by a screen printing method. To form first vertical strip lines 120*b* and 120*c*, via holes (not shown) are formed into second and third ceramic sheets 150 and 160, which are filled with conductive material. Conductive material, like silver (Ag) paste, is preferably used to thickly print a plurality of metallic horizontal strip lines to fill the via holes. Second horizontal strip lines 120*d* are thickly printed on third ceramic sheet 160. First horizontal strip lines 120*a*, first vertical strip lines 120*b* and 120*c*, and second horizontal strip lines 120*d* are electrically connected to form first helical conductor 120 of ceramic chip antenna 300.

Second helical conductor 130 of ceramic chip antenna 300 is similarly produced. Third horizontal strip lines 130*a* are thickly printed on first ceramic sheet 140, and via holes (not shown) are formed into second and third ceramic sheets 150 and 160, which are filled with conductive material to form second vertical strip lines 130*b* and 130*c*. Fourth horizontal strip lines 130*d* are thickly printed on third ceramic sheet 160. Third horizontal strip lines 130*a*, second vertical strip lines 130*b* and 130*c*, and fourth horizontal strip lines 130*d* are all electrically connected. Even though the plurality of horizontal strip lines 120*d* and 130*d* and vertical strip lines 120*c* and 130*c* are illustrated in FIG. 4A as being separated from each other on third ceramic sheet 160, vertical strip lines 120*c* and 130*c* must be formed to abut horizontal strip lines 120*d* and 130*d* to provide electrical connection.

As previously explained, first horizontal strip lines 120*a* and third horizontal strip lines 130*a* constituting first and second helical conductors 120 and 130 are thickly printed on first ceramic sheet 140 in turn. Second and fourth horizontal strip lines 120*d* and 130*d* are thickly printed on third ceramic sheet 160 in turn. First vertical strip lines 120*b* and 120*c* constituting first helical conductor 120, and second vertical strip lines 130*b* and 130*c* constituting second helical conductor 130 are formed in turn on second and third ceramic sheets 150 and 160. Therefore, the process of thick printing and laminating the dielectric ceramic sheets can be simplified. Since the number and length of the metallic strip lines are identical for the two helical conductors, first and second helical conductors 120 and 130 shown in FIG. 3 have the same length.

The T-type power supply section is connected to first and second helical conductors 120 and 130 to provide a supply voltage, which is input from the exterior of main body 300, to first and second helical conductors 120 and 130. This T-type power supply section is characterized by a T-shaped film 110*a* printed on the top surface of second ceramic sheet 150 to extend from one of the edges of second ceramic sheet 150 where the top surface of second ceramic sheet 150 meets a right end surface 150*a* of second ceramic sheet 150, as shown in FIG. 4A. T-shaped film 110*a* is arranged on second ceramic sheet 150 such that first end 110*b* of film 110*a* coincides with the afore-mentioned edge of second ceramic sheet 150. The structure and method of formation of the T-type power supply section on first to third ceramic sheets 140–160 will be described in detail with reference to FIG. 4B.

Figure 4B:
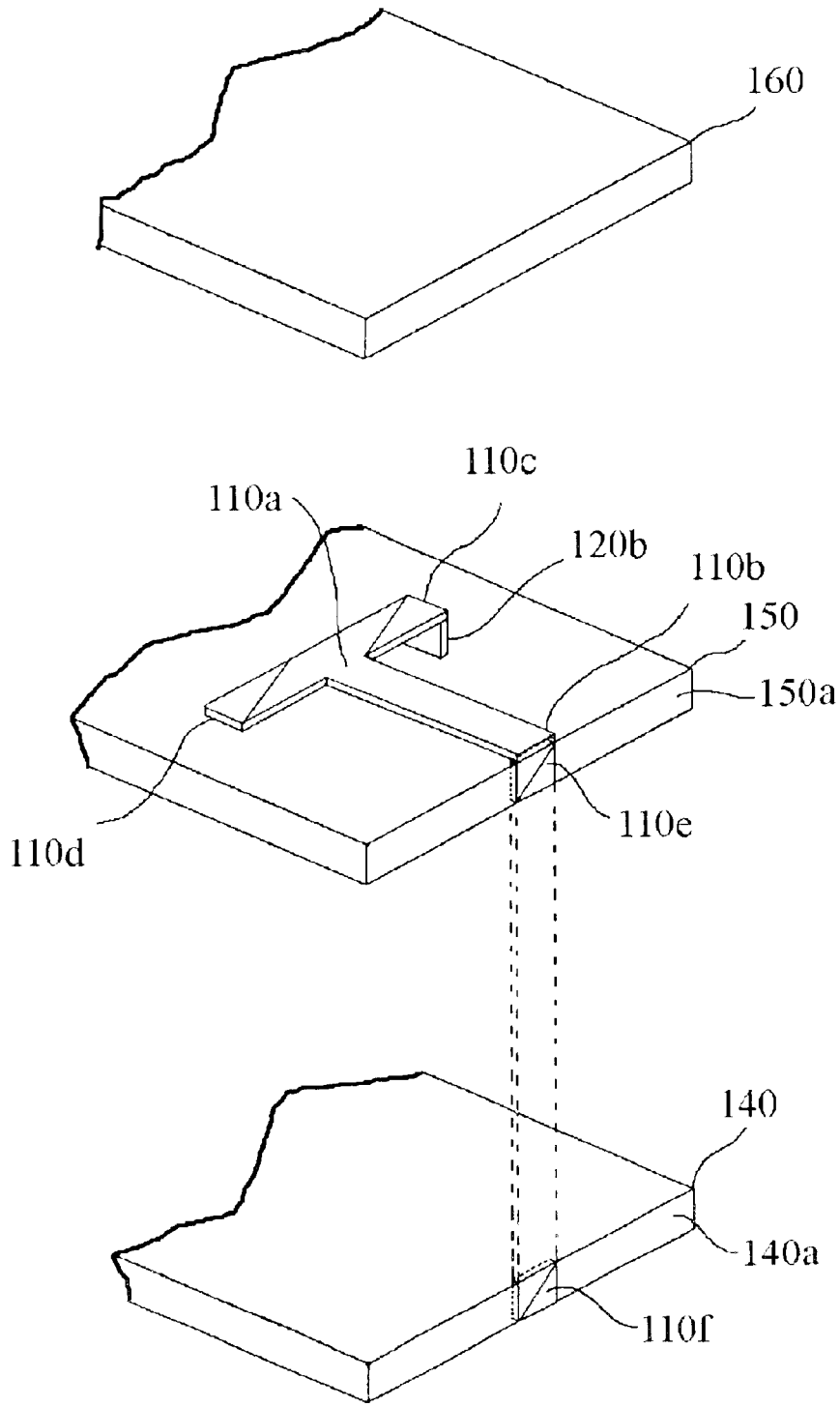
FIG. 4B is a detailed view of the power supply section of the ceramic chip antenna shown in FIG. 4A.

As shown in FIG. 4B, third vertical strip line 110*e* is formed in a recessed portion of end surface 150*a* of second ceramic sheet 150 such that the outer surface of third vertical strip line 110*e* is coplanar with end surface 150*a* of second ceramic sheet 150. Likewise, fourth vertical strip line 110*f* is formed in a recessed portion of end surface 140*a* of first ceramic sheet 140 such that the outer surface of fourth vertical strip line 110*f* is coplanar with end surface 140*a* of first ceramic sheet 140. The outer surfaces of third and fourth vertical strip lines 110*e* and 110*f* are exposed to the exterior. First end 110*b* of T-shaped film 110*a* is connected to the upper surface of third vertical strip line 110*e* in a vertical relationship, and the lower surface of third vertical strip line 110*e* is connected to the upper surface of fourth vertical strip line 110*f*. With this structure, the lower surface of fourth vertical strip line 110*f* is coplanar with the lower surface of first ceramic sheet 140 and is exposed to the exterior. Next, second end 110*c* and third end 110*d* of T-shaped film 110*a* are connected to first helical conductor 120 and second helical conductor 130, respectively. Therefore, a voltage input from the exterior of main body 105 can be transmitted to first and second helical conductors 120 and 130 through fourth and third vertical strip lines 110*f* and 110*e*.

The ceramic chip antenna may be used as an antenna element of a mobile phone. For such application, the ceramic chip antenna is usually mounted on, for example, the surface of the substrate of a mobile phone by a soldering method. In order to improve stability in surface-mounting, preferably a plating treatment is conducted over: a portion of the lower surface of first ceramic sheet 140, including the externally exposed lower surface of fourth vertical strip line 110*f*; at least a central portion of end surface 140*a* of first ceramic sheet 140, including the externally exposed outer surface of fourth vertical strip line 110*f*; at least a central portion of end surface 150*a* of second ceramic sheet 150, including the externally exposed outer surface of third vertical strip line 110*e*; and at least a central portion of the end surface of third ceramic sheet 160.

Figure 1:
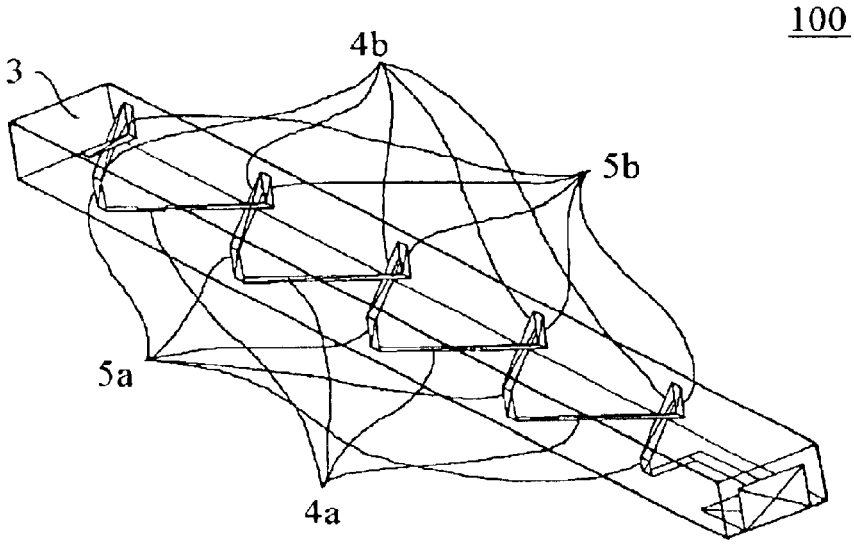
Fig. 1 (PRIOR ART)
FIG. 1 shows a structure of a conventional ceramic chip antenna including a helical conductor having a single helix structure.
Figure 2A:
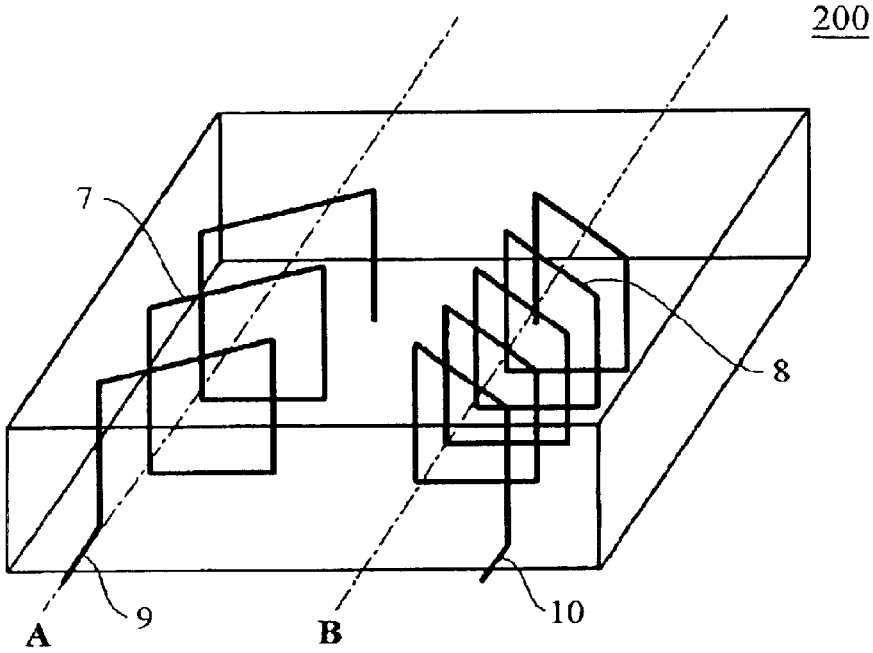
Fig. 2A (PRIOR ART)
FIG. 2A shows a structure of a conventional ceramic chip antenna including two helical conductors composed of two helices having different axes of helical rotation.
Figure 2B:
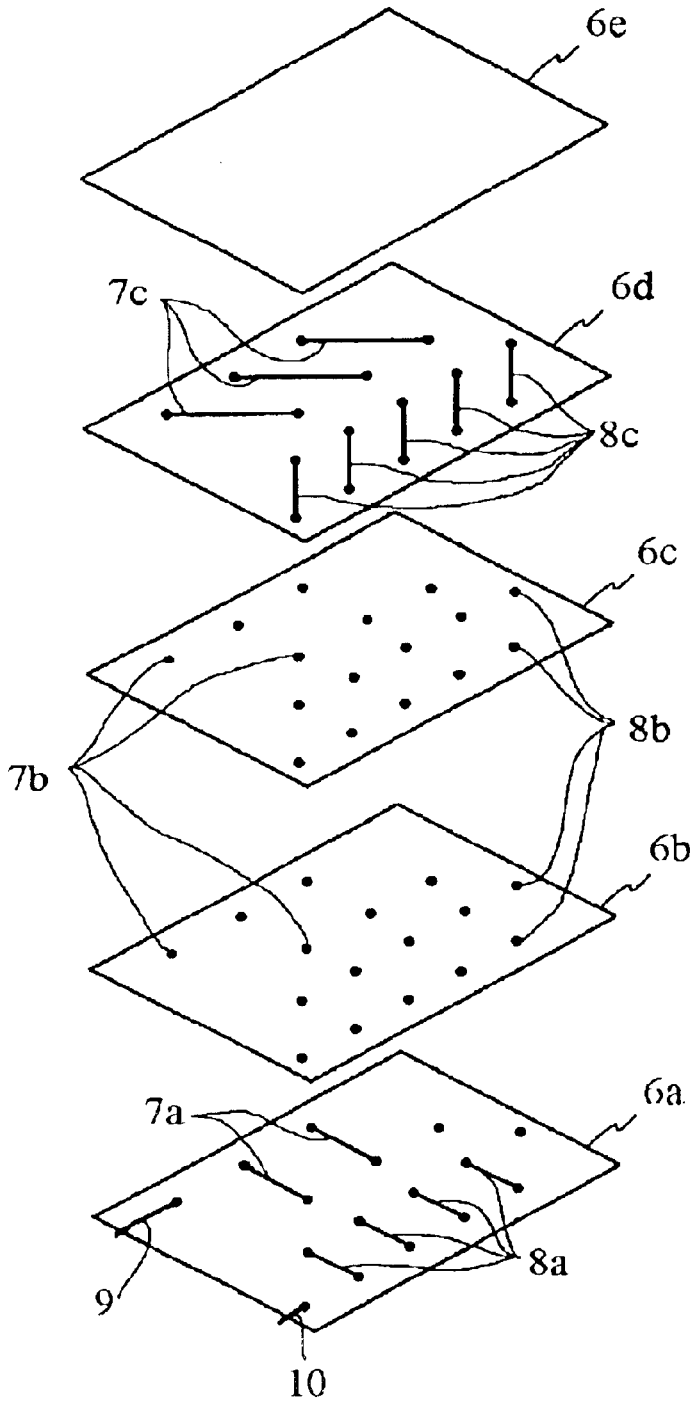
Fig. 2B (PRIOR ART)
FIG. 2B is an exploded view of the ceramic chip antenna shown in FIG. 2A.
Figure 5:
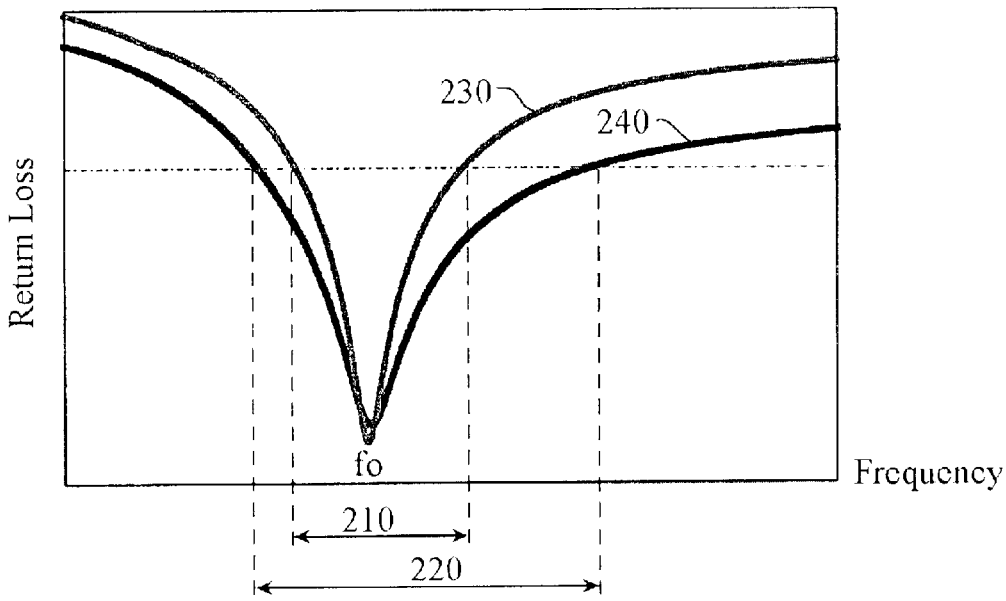
FIG. 5 is a graph of the frequency bandwidth characteristics of the ceramic chip antennas shown in FIGS. 1 and 3.

FIG. 5 is a graph of the frequency bandwidth characteristic curve 230 of conventional ceramic chip antennas 100 shown in FIG. 1 and the frequency bandwidth characteristic curve 240 of ceramic chip antenna 300 of FIG. 3 according to the present invention. In FIG. 5, the ordinate and the abscissa represent the return loss of the antenna and the frequency, respectively. As described above, the ceramic chip antenna of the present invention is designed such that the length of the first helical conductor is equal to that of the second helical conductor. As a result, the first and second helical conductors resonate at the same center frequency fo. Accordingly, bandwidth 220 of ceramic chip antenna 300, which is embodied by the helical conductors of a dual-helix type, is broader than bandwidth 210 of conventional ceramic chip antenna 100, which is embodied by the helical conductor of the single-helix type.

Figure 6:
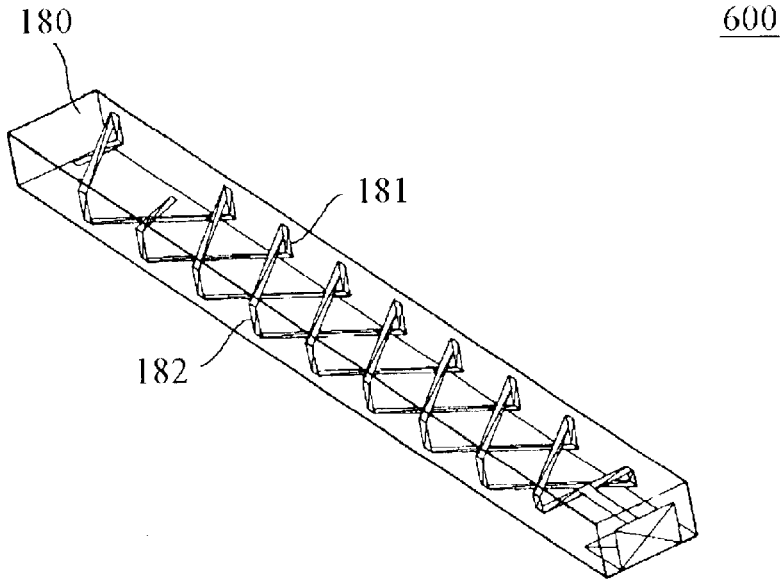
FIG. 6 shows a structure of a ceramic chip antenna in accordance with another embodiment of the present invention.
Figure 7:
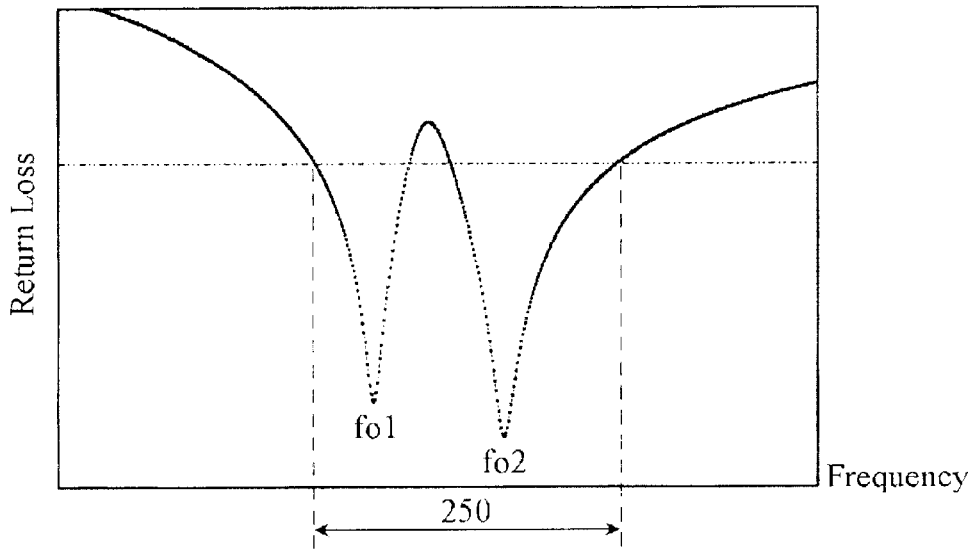
FIG. 7 is a graph of the frequency bandwidth characteristic of the ceramic chip antenna shown in FIG. 6.

FIG. 6 shows a structure of a ceramic chip antenna in accordance with another embodiment of the present invention. Ceramic chip antenna 600 comprises a main body 180 formed by laminating plural ceramic sheets, and two helical conductors 181 and 182 for forming a dual helix structure inside main body 180, as in ceramic chip antenna 300. The processes of forming the dual helix structure inside main body 180 are similar to those described in connection with ceramic chip antenna 300, and the detailed explanation thereof is omitted herein. According to this embodiment, however, the numbers of horizontal strip lines and vertical strip lines are different for the two helical conductors. As a result, first helical conductor 181 and second helical conductor 182 have different lengths so that they resonate at the two different resonant frequencies $fo_1$, $fo_2$, as shown in FIG. 7. Accordingly, bandwidth 250 for ceramic chip antenna 600 can be further extended as compared to that obtainable by ceramic chip antenna 300.

As mentioned above, the ceramic chip antennas according to the present invention described in conjunction with FIGS. 3–7 can meet the frequency bandwidth characteristics required by wireless communication systems such as a mobile phone, WLAN, Bluetooth etc. Particularly, the structure of the antenna can be made as similarly simple as if a single-helix type antenna were formed, because a plurality of helical conductors are connected to only one power supply section.

While the present invention has been shown and described with respect to the particular embodiment, it will be apparent to those skilled in the art that many exchanges and modifications may be made without departing from the spirit and scope of the invention as defined in the appended claims.

What is claimed is:

1. A ceramic chip antenna comprising:

a main body formed by laminating a plurality of ceramic sheets made of a dielectric material;

a first helical conductor and a second helical conductor formed inside the main body; and a power supply section coupled to the first and second helical conductors for supplying power thereto, wherein the first and second helical conductors have the same axis of helical rotation as viewed from the power supply section, and the power supply section comprises a T-shaped film having three ends thickly printed on a predetermined ceramic sheet.

2. The ceramic chip antenna of claim 1, wherein the first helical conductor is produced by connecting first horizontal strip lines formed on the first ceramic sheet, first vertical strip lines formed on the second and third ceramic sheets, and second horizontal strip lines formed on the third ceramic sheet.

3. The ceramic chip antenna of claim 2, wherein the second helical conductor is produced by connecting third horizontal strip lines formed on the first ceramic sheet, second vertical strip lines formed on the second and third ceramic sheets, and fourth horizontal strip lines formed on the third ceramic sheet.

4. The ceramic chip antenna of claim 1, wherein the first helical conductor is connected to the second end of the T-shaped film, and the second helical conductor is connected to the third end of the T-shaped film.

5. The ceramic chip antenna of claim 3, wherein the first and third horizontal strip lines are thickly printed on the first ceramic sheet.

6. The ceramic chip antenna of claim 3, wherein the second and fourth horizontal strip lines are thickly printed on the third ceramic sheet.

7. The ceramic chip antenna of claim 1, wherein the first and second helical conductors have the same length.

8. The ceramic chip antenna of claim 1, wherein the first and second helical conductors have different lengths.

* * * * *